US008573237B2

(12) United States Patent
Crum

(10) Patent No.: US 8,573,237 B2
(45) Date of Patent: Nov. 5, 2013

(54) APPARATUS AND METHOD FOR CLEANING HEAT EXCHANGERS

(76) Inventor: Jerry Crum, Okemah, OK (US)

( * ) Notice: Subject to any disclaimer, the term of this patent is extended or adjusted under 35 U.S.C. 154(b) by 0 days.

(21) Appl. No.: 13/192,249

(22) Filed: Jul. 27, 2011

(65) Prior Publication Data

US 2012/0048513 A1 Mar. 1, 2012

Related U.S. Application Data

(60) Provisional application No. 61/376,354, filed on Aug. 24, 2010.

(51) Int. Cl.
*B08B 3/12* (2006.01)

(52) U.S. Cl.
USPC ..... 134/198; 134/133; 134/166 R; 239/532; 239/592; 239/597

(58) Field of Classification Search
USPC ..... 239/532, 592, 597, 598, 599, 601; 134/22.1, 22.12, 166 R, 42, 201, 22.18
See application file for complete search history.

(56) References Cited

U.S. PATENT DOCUMENTS

| | | | | | |
|---|---|---|---|---|---|
| 4,239,490 | A * | 12/1980 | Kelly et al. | 8/499 |
| 4,834,131 | A * | 5/1989 | Austin | 137/115.26 |
| 4,982,896 | A * | 1/1991 | Crow | 239/11 |
| 4,998,993 | A * | 3/1991 | Kenderi et al. | 239/295 |
| 5,478,014 | A * | 12/1995 | Hynds | 239/135 |
| 7,028,925 | B2 * | 4/2006 | Guest et al. | 239/526 |
| 7,798,428 | B1 * | 9/2010 | Weil | 239/420 |
| 2004/0173631 | A1 * | 9/2004 | Soussan et al. | 222/1 |
| 2008/0120802 | A1 * | 5/2008 | Harvey | 15/405 |
| 2008/0257528 | A1 * | 10/2008 | Johnson et al. | 165/95 |
| 2010/0326470 | A1 * | 12/2010 | Seippel | 134/14 |

* cited by examiner

*Primary Examiner* — Eric Golightly
*Assistant Examiner* — Arlyn I. Rivera-Cordero
(74) *Attorney, Agent, or Firm* — Shimokaji & Assoc., P.C.

(57) ABSTRACT

A tool for cleaning heat exchangers may include a fluid flow control valve, a hollow elongated stem attached to the valve and a hollow fan head attached to the hollow stem. The fan head may have a fan-head axis oriented at an oblique angle relative to a stem axis of the stem.

5 Claims, 3 Drawing Sheets

APPARATUS AND METHOD FOR CLEANING HEAT EXCHANGERS

RELATED APPLICATIONS

This application claims the benefit of U.S. Provisional Patent Application No. 61/376,354 filed on Aug. 24, 2010.

BACKGROUND OF THE INVENTION

The present invention generally relates to a system for cleaning radiators and heat exchangers with compressed air or water.

Motorized vehicles employ various radiators or heat exchangers to provide engine cooling, hydraulic fluid cooling and air conditioning refrigerant cooling. When a vehicle such as a truck, tractor or earth moving unit is operated in a dusty environment, the heat exchangers may become clogged with dust or debris.

As shown in a schematic diagram of FIG. 1, multiple heat exchangers 100 may be positioned in a stacked relationship at a front end of a vehicle 102. Protective shrouds 104 may be provided around one or more of the heat exchangers 100. The collective configuration of stacked heat exchangers and shrouds may present a challenging setting for introduction of a compressed air or water cleaning tool.

As can be seen, there is a need for a tool that may be employed to clean heat exchangers which may be in a stacked relationship to one another.

SUMMARY OF THE INVENTION

In one aspect of the present invention, apparatus for cleaning heat exchangers may comprise: a fluid flow control valve; a hollow elongated stem attached to the valve; and a hollow fan head attached to the hollow stem, the fan head having a fan-head axis oriented at an oblique angle relative to a stem axis of the stem.

In another aspect of the present invention, a method for cleaning a heat exchanger may comprise the steps of: providing for positioning a stem of a cleaning tool at an oblique angle relative to a plane of the heat exchanger so that an axis of a fan head of the cleaning tool is perpendicular to the plane of the heat exchanger; and providing for passing pressurized fluid through the fan head to drive dust or debris from the heat exchanger.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a cleaning system for removing collected dust and debris from heat exchangers, and more particularly from multiple closely spaced heat exchangers.

Figure 1:
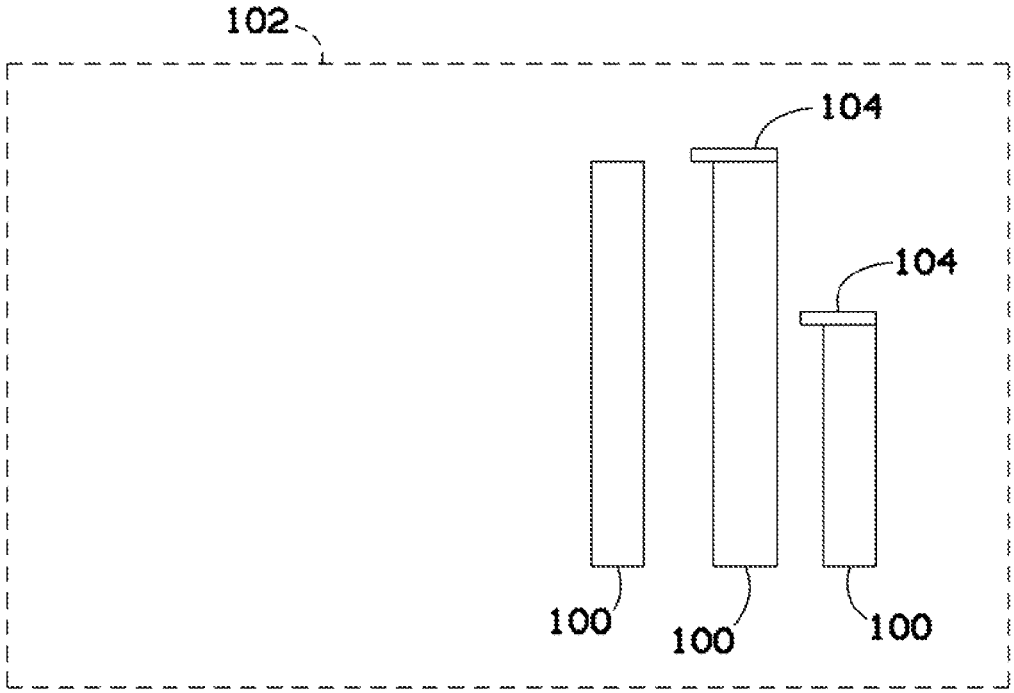
FIG. 1 (PRIOR ART)
FIG. 1 is a schematic diagram of heat exchangers in accordance with the prior art.
Figure 2:
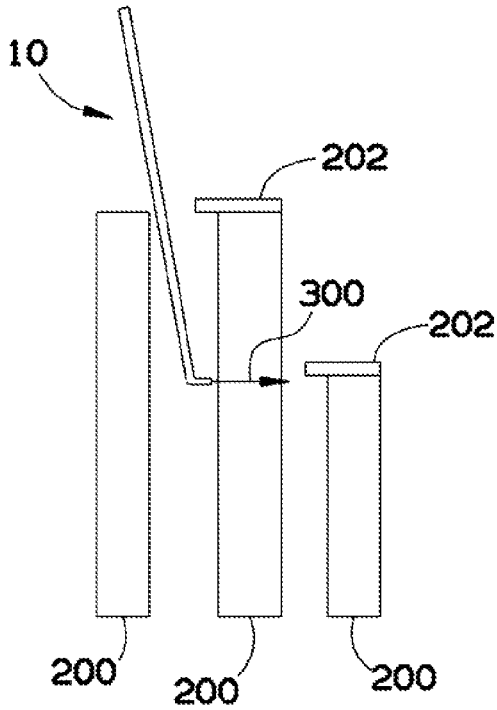
FIG. 2 is a schematic diagram of heat exchangers and a cleaning tool in accordance with an embodiment of the invention.
Figure 3:
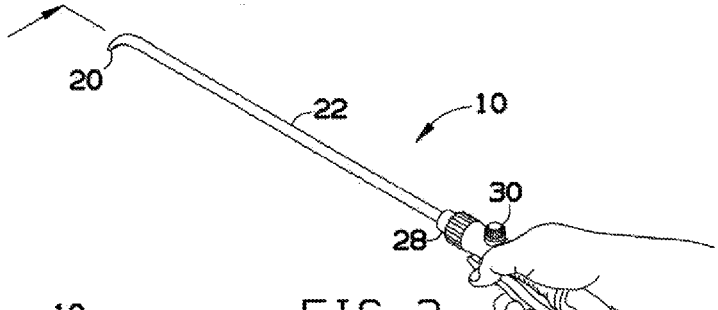
FIGS. 3 and 4 are perspective views of the cleaning tool of FIG. 2 in accordance with an embodiment of the invention.
Figure 4:
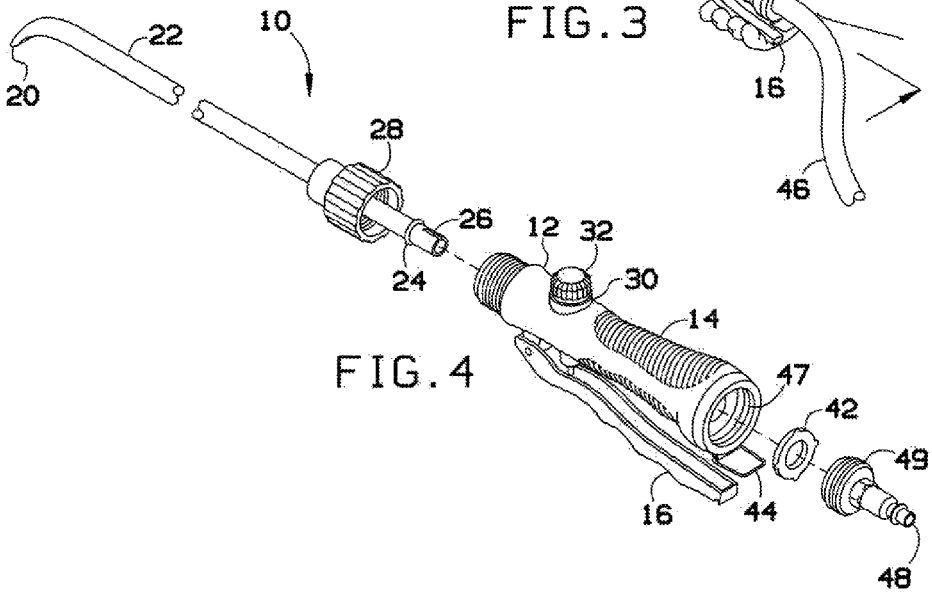
Figure 5:
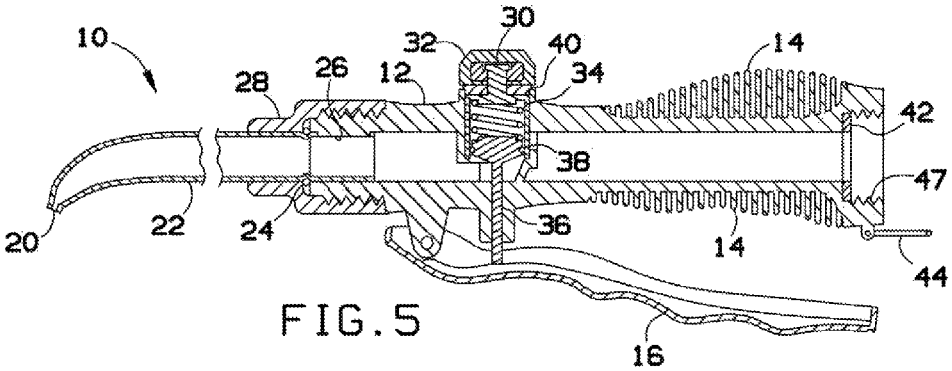
FIGS. 5 through 7 are sectional views of the cleaning tool of FIG. 2.
Figure 6:
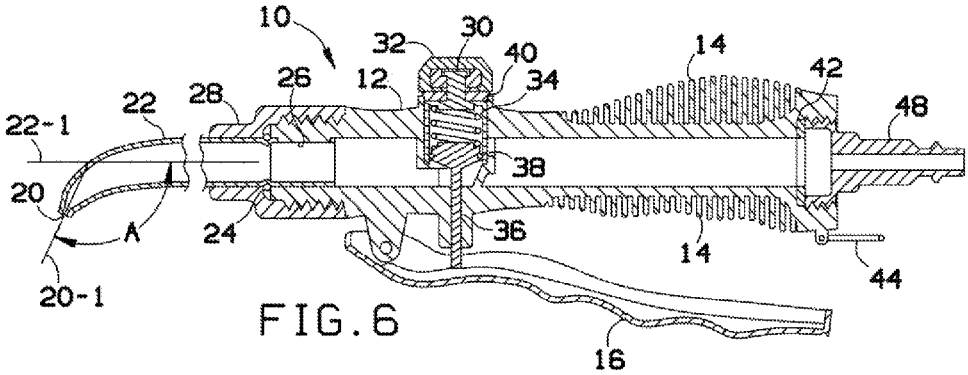
Figure 7:
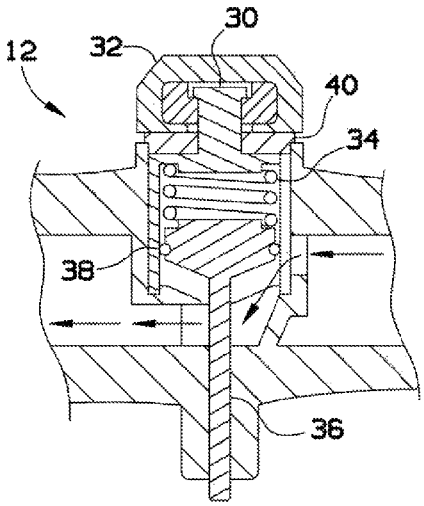
Figure 8:
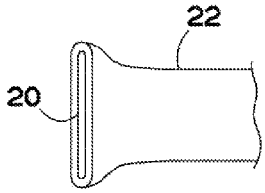
FIG. 8 is a detailed view of a fan head of the tool of FIG. 2.

Referring now to FIG. 2, it may be seen that an exemplary embodiment of a cleaning tool 10 may have an angled configuration that may accommodate placement of the tool 10 between adjacent heat exchangers 200 and below shrouds 202 that may overly one or more of the heat exchangers 200. Pressurized fluid such as air or water flow 300 may emerge from the tool 10 in a direction that is perpendicular to the planes of the heat exchangers 200 even though a principal axis of the tool 10 may not be parallel to the planes.

Referring now to FIGS. 3 through 8 it may be seen that an exemplary embodiment of the cleaning tool 10 may comprise a valve 12, a grip 14, a hand-operated valve trigger 16, a high pressure fan head 20, a hollow cylindrical stem 22, a stem o-ring 24, a stem key slot 26, a coupler 28, a valve flow adjustment 30, a flow adjustment cover 32, a valve spring 34, a valve core 36, a valve o-ring 38, a valve cover 40, a seal 42 and a valve lock 44.

The stem 22 may comprise a hollow tube with an outside diameter of about ½ inch and an inside diameter of about 7/16 inch. The fan head may be formed integrally with the stem 22. The fan head 20 may have an elongated opening about 1/16 inch wide and about ¾ inch to about one inch long. An axis 20-1 of the fan head 20 may be oriented at an oblique angle A relative to an axis 22-1 of the stem 22. Advantageously the angle A may be about 110° to about 150°.

In operation, the tool 10 may be connected to an air compressor hose (not shown) with a quick-connect fitting 48. The stem 22 of the tool 10 may then be inserted between the heat exchangers 200 as shown in FIG. 2. The valve trigger 16 may be depressed and a flow 300 of air may be released onto the heat exchanger 200 thus blowing away dust and debris.

Alternatively, a water hose 46 may be attached to the tool 10 by threading a fitting of the water hose into internal threads 47. In this context, the flow 300 may be a flow of water.

It may be noted that the internal threads 47 may be configured to accept a water hose connection. The quick disconnect fitting 48 may be constructed with external threads 49 that match threads of a water hose fitting. Thus the tool 10 may be used interchangeably with either water or air.

It should be understood, of course, that the foregoing relates to exemplary embodiments of the invention and that modifications may be made without departing from the spirit and scope of the invention as set forth in the following claims.

What is claimed is:

1. An apparatus for cleaning heat exchangers comprising:

a cylinder-shaped hollow handle having a fluid flow control valve, the hollow handle having internal threads formed therein which threads are configured to accommodate male threads of a water hose connector;

a hollow elongated stem attached to the valve; and a hollow fan head integrally formed with the hollow stem, the hollow fan head having an elongated opening, the elongated opening being laterally displaced from a stem axis of the stem by a distance no greater than 1½ times an outer diameter of the stem, and the hollow fan head having a fan-head axis oriented at an angle between 110° to 150° relative to the stem axis of the stem.

2. The apparatus of claim 1 wherein the stem is cylindrical and has an outside diameter of about ½ inch.

3. The apparatus of claim 1 wherein the stem has an inside diameter of about 7/16 inch and the fan head has an opening that is about 1/16 inch wide and between about ¾ inch to about one inch long.

4. The apparatus of claim 1 further comprising:

a quick-disconnect air hose fitting having a male thread formed thereon configured to accommodate the internal thread of the handle; and an annular seal positioned in the hollow handle for engagement with the quick-disconnect air hose fitting.

5. The apparatus of claim 1 further comprising a hand-operated valve trigger connected to the valve.

* * * * *